United States Patent [19]

Goodwin

[11] Patent Number: 5,031,533

[45] Date of Patent: Jul. 16, 1991

[54] ADJUSTABLE INK FOUNTAIN FOR DUPLICATING MACHINES

[75] Inventor: Eber L. Goodwin, Arlington Heights, Ill.

[73] Assignee: AM International, Inc., Chicago, Ill.

[21] Appl. No.: 420,907

[22] Filed: Oct. 13, 1989

[51] Int. Cl.[5] ..... B41F 31/02; B41F 33/00

[52] U.S. Cl. ..... 101/365; 116/309

[58] Field of Search ..... 101/350, 351, 352, 363, 101/364, 365; 116/309, 297, 294, 307, 280

[56] References Cited

U.S. PATENT DOCUMENTS

| | | | |
|---|---|---|---|
| 1,112,412 | 9/1914 | Adam | 101/365 |
| 2,549,332 | 4/1951 | Parker | 116/309 |
| 2,902,927 | 9/1959 | Ross | 101/365 |
| 3,623,430 | 11/1971 | Lessun | 101/365 |
| 4,008,664 | 2/1977 | Crum et al. | 101/365 |
| 4,196,691 | 4/1980 | Imazeki | 116/309 |
| 4,398,465 | 8/1983 | Pozin | 101/365 |
| 4,406,224 | 9/1983 | Hajek | 101/363 |
| 4,440,084 | 4/1984 | Pozin | 101/365 |
| 4,553,477 | 11/1985 | Witczak | 101/365 |
| 4,685,417 | 8/1987 | Kronseder | 101/365 X |

*Primary Examiner*—Clifford D. Crowder

*Attorney, Agent, or Firm*—Wood, Phillips, Mason, Recktenwald & Van Santen

[57] ABSTRACT

An ink fountain assembly for use in duplicating machines, such as rotary offset lithographic machines. A fountain trough is defined by an elongated blade extending along one side of the trough and an ink fountain roller extending along the other side of the trough defining a gap therebetween. A plurality of independently adjustable thumb screws are provided for varying the gap and the ink flow therethrough. A plurality of caps are positionable over the thumb screws in any angular position relative thereto. The caps have indicators to facilitate calibrating the positions of adjustment of the thumb screws.

5 Claims, 1 Drawing Sheet

ADJUSTABLE INK FOUNTAIN FOR DUPLICATING MACHINES

FIELD OF THE INVENTION

This invention generally relates to duplicating machines and, more particularly, to ink fountain assemblies for use in duplicating machines.

BACKGROUND OF THE INVENTION

Printing machines, such as rotary offset lithographic duplicating machines, rotary printing presses, or the like, normally include a printing couple which includes a number of cylinders and/or rollers such as impression cylinders, master cylinders, blanket cylinders, ductor rollers, regulator rollers, and the like. An ink fountain is disposed on the machine, usually at the rear thereof, for feeding ink to the various rollers of the printing couple which transfers images to copy sheets.

Conventional ink fountain assemblies normally take the form of a fountain trough defined by an elongated blade extending along one side and an ink fountain roller extending along the opposite side of the trough. The ink fountain roller transfers the ink to the other rollers of the printing couple. The blade is adjustable by a plurality of thumb screws spaced longitudinally of the blade to vary a "gap" between an edge of the blade and the ink fountain roller in order to maintain consistency in the amount of ink applied to the roller uniformly along the length of the roller and to adjust the ink fountain "setting" for any given printing job. The thumb screws are individually rotatably adjustable, i.e. independently of each other, and usually have an inner distal end which moves against the underside of the blade to move the blade toward and away from the roller and, thereby, vary the gap.

The normal procedure of setting an ink fountain, i.e., the flow of ink through the gap, is a trial and error method. Specifically, a job copy is inspected and all of the adjustable thumb screws are set by sheer estimation. A number of trial copies are run on the machine and the results are observed. The thumb screws are adjusted for too little or too much ink being fed through the gap in the area of each screw. Another trial run is performed, and the procedure is repeated until an acceptable copy is made, taking into consideration proper ink coverage, color density, resolution, ink film thickness and ink drying time. Densitometers or other instruments may be used during the procedure. In actual practice, a very experienced machine operator becomes very proficient with these procedures. However, less experienced operators cause cost effectiveness problems, and beginner or trainee operators often have extraordinary problems in attaining acceptable copies.

The above scenario results in further inefficiency problems, even with an experienced machine operator, because of the inability of efficiently duplicating a precise ink fountain "setting" once the setting is changed either intentionally or inadvertently. For instance, a printing run or job of 10,000 sheets may be on order. Once the job is finished, another job is started, with the thumb screws adjusted to a completely different fountain setting. Thereafter, whether a day later or months later, if an order for the previous job must be repeated, there is no way to duplicate the paper ink fountain setting without again following the usual trial and error procedure. Such periodic or repeat orders are quite common in the print shop business.

In addition, should any one or more of the thumb screws be rotated out of their proper position of adjustment, either accidentally or through tampering, there is no way to detect that the thumb screws are out of adjustment.

The above problems easily can be visualized when considering that the thumb screws simply have knurled heads for manually adjustably rotating the screws. In some instances the screws have diametral slots in the outer face of the heads for receiving a tool, such as a screwdriver, for rotatably adjusting the screws. In any event, one thumb screw usually is rotated, in its proper position of adjustment, to a different angle than its adjacent or other screws. Therefore, even if the heads have a tool-receiving slot, the slots may appear in all kinds of angular orientations. There is no way to repeat at a later time all of the respective angular positions of the screws, and there is no way to detect whether or not any of the screws have been unintentionally rotated away from the positions in which they were initially rotated to proper adjustment.

There are various known, sophisticated scanning mechanisms used in high priced presses for setting ink fountain screws by servo-motors or similar devices and which can be repeatable. The mechanisms are computerized and feed back signals from the scanners to the ink fountain screws. However, such mechanisms can cost almost as much as an entire print shop machine.

This invention is directed to solving the above problems by providing a unique system including a visual calibrated system of setting an ink fountain and including indicating means removably mountable on each thumb screw for facilitating repeat setting of the ink fountain and for detecting any movement of the thumb screws away from their proper positions of adjustment.

SUMMARY OF THE INVENTION

An object, therefore, of the invention is to provide a novel system for setting and calibrating the thumb screws of an ink fountain assembly.

In the exemplary embodiment of the invention, an ink fountain assembly is disclosed for use in duplicating machines, such as rotary offset lithographic machines. The ink fountain includes a fountain trough having an elongated blade and an ink fountain roller defining a gap therebetween through which ink is fed to other rollers of the machine. A plurality of independently adjustable thumbscrews are provided for varying the gap and the ink flow therethrough. Generally, positional indicating means are readily mountable on the thumb screws once the thumb screws are in proper positions of adjustment for visually calibrating the ink fountain setting.

As disclosed herein, the positional indicating means are in the form of a plurality of caps positionable over the thumb screws, as by a press fit. The caps can be fit over the thumb screws in any angular position relative thereto. The invention contemplates that the caps have indicating means thereon. A calibration plate is positioned behind the caps with a calibration dial in the form of a graduated scale about each cap. Once all of the thumb screws are set to attain an even flow of ink through the gap along the entire ink fountain blade, which can be termed a "base line" setting, the caps then are positioned over the thumb screws with all the indicators in a common direction. The caps then are used to further adjust the thumb screws to a particular fountain setting for a particular job. Once set, a job record can be made for that job by recording the positions of the indicators on the caps in relation to their respective calibrations on the dials. Any job easily can be precisely repeated, regardless of subsequent ink fountain settings, by referring to the job record.

Other features of the invention include the provision of means for locking the caps to the respective thumb screws, as well as means for preventing rotation of the thumb screws more than 360 degrees after the caps are positioned thereon. These features can be provided by a common means in the form of a set screw which projects radially outwardly from the side of each cap. The set screws lock the caps to the thumb screws and, in combination with abutment means on the ink fountain assembly, provide stop means to prevent excessive rotation of the thumb screws and caps.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
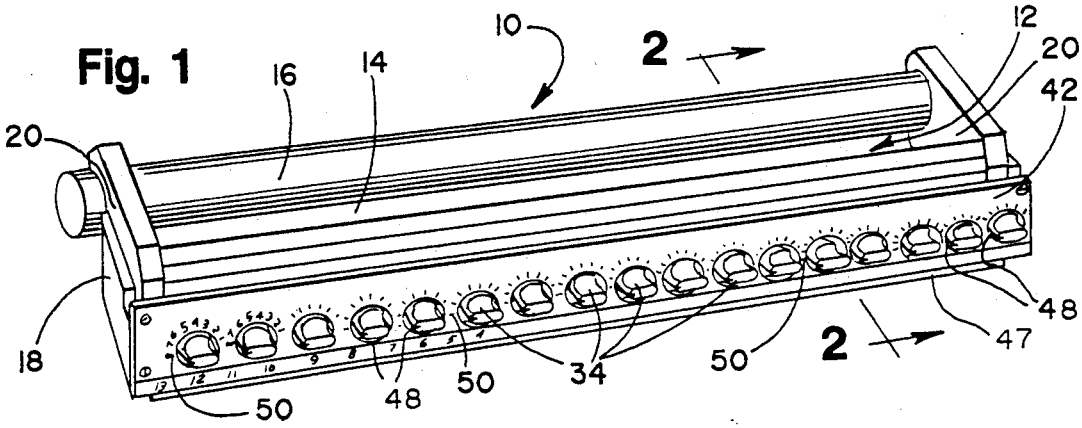
FIG. 1 is a perspective view of a typical ink fountain assembly but incorporating the calibrated adjusting system of the invention.

Referring to the drawings in greater detail, and first to FIG. 1, a typical ink fountain assembly, generally designated 10, is shown to include a fountain trough, generally designated 12, defined by an elongated blade 14 extending along one side of the trough and an ink fountain roller 16 extending along the other side of the trough. The blade and roller are mounted on a frame 18 which includes a pair of side plate portions 20. As is conventional, the blade is secured to the frame by a plurality of threaded fasteners (not shown). One form of ink fountain assembly is shown in U.S. Pat. No. 4,553,477 to Witczak, dated Nov. 19, 1985 and assigned to the assignee of this invention, and which is incorporated herein by reference.

Figure 2:
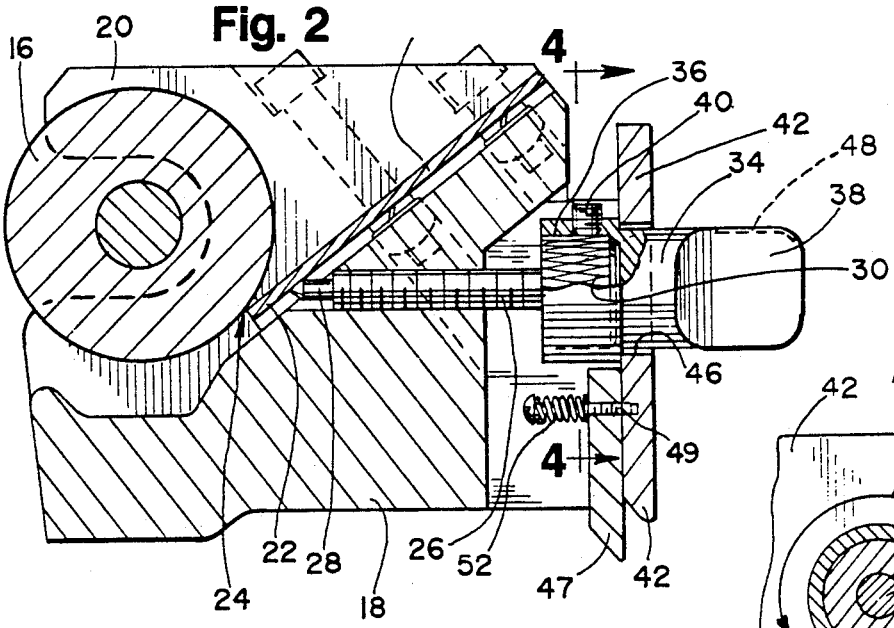
FIG. 2 is a fragmented front elevational view, on an enlarged scale, of the assembly of FIG. 1.

FIG. 2 shows a section through the ink fountain assembly to better illustrate that an edge 22 of blade 14 defines a gap, generally designated 24, between the blade and ink fountain roller 16 through which ink is fed onto the surface of roller 16 which transfers the ink to other rollers of the printing or duplicating machine which eventually transfer images to copy sheets. As is known, a plurality of thumb screws 26 are threaded through frame 18, with distal ends 28 of the thumb screws angularly abutting against the underside of blade 14. By adjusting the thumb screws, gap 24 between blade 14 and roller 16 can be varied along the length of the roller to maintain a consistent thickness of ink applied to the roller uniformly along the blade.

As is conventional, and still referring to FIG. 2, each thumb screw 36 has an enlarged knurled head 30 exposed at the front of frame 18 for grasping and rotating by an operator of the machine, as between his thumb and index finger. Although only one thumb screw is shown in FIG. 2, as is known, the thumb screws are spaced longitudinally along the underside of blade 14 lengthwise of the ink fountain assembly. Often, the thumb screws also may have a slot in the outer face thereof (not shown in the drawing) for receiving a tool, such as a screwdriver, to facilitate rotatably adjusting the thumb screws.

A problem with ink fountain assemblies as described above is that once the thumb screws all are rotatably adjusted to proper positions of adjustment to establish the desired gap 24 lengthwise along blade 14 and roller 16 for any given job as described above, that ink fountain "setting" is unique to that job and cannot later be repeated without completely going through the setting or adjusting procedure again. In addition, there is no way for the operator to detect whether or not any one or more of the thumb screws have been rotated subsequent to proper adjustment. This easily can be understood when it is recognized that the thumb screws simply have a knurled head on the outer distal end thereof. Even if the thumb screws have a diametral slot for receiving a tool, the slots are in a myriad of angular orientations depending upon their proper individual adjustable setting. Any improper rotation of any screw will give no indication whatsoever. Generally, this invention is directed to solving these problems by providing a novel visual calibration system including indicating means readily mountable on each thumb screw and an associated calibration dial for each indicating means.

More particularly, in the exemplary embodiment of the invention, a plurality of caps 34 have inner socket portions 36 (FIG. 2) for press fitting over heads 30 of thumb screws 26. Sockets 36 are cylindrical in shape for mating with the exterior round shape of heads 30 so that the caps can be readily positioned onto the heads in any angular position relative thereto. Each cap has a narrow outer distal end portion 38 for grasping between the thumb and index finger of an operator. As seen in FIG. 2, means in the form of set screws 40 are threaded through sockets 38 of caps 34 for locking the caps to heads 30 of the thumb screws.

Figure 3:
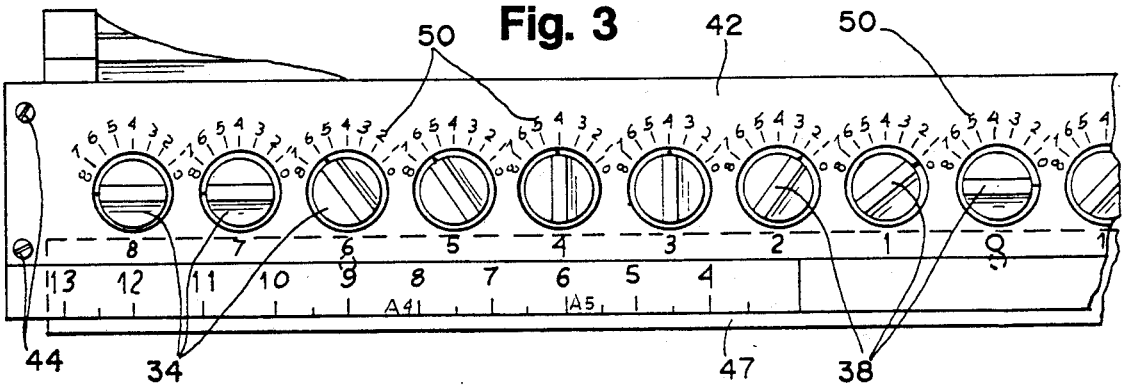
FIG. 3 is a vertical section, on an enlarged scale, taken generally along line 3—3 of FIG. 2.

An elongated face plate 42 is clamped to frame 18, as by screws or bolts 44 (FIG. 3). As seen in FIG. 2, face plate 42 extends upwardly beyond set screws 40 a given distance. This distance can be designed to be greater than the conventional Allen wrench which must be used in order to rotate the set screws and change the relative positions between the caps and their respective set screws. It also can be seen in FIG. 2 that face plate 42 has apertures 46 which are large enough to fit over caps 34 but smaller than socket portions 36 of the caps so that the caps cannot be removed without removing the face plate. For purposes described hereinafter, an abutment/clamp plate 47 is secured to the back side of face plate 42 by spring-loaded bolt 49. The clamp plate extends downwardly from the lower edge of the face plate to define an exposed lip, as seen in FIGS. 1 and 3.

FIG. 1 shows that each cap 34 has a straight line indicator 48 on the side thereof, and FIGS. 1 and 3, show that face plate 42 has numerical calibrations 50 imprinted on the front face of the plate. Each calibration 50 is in the form of a dial, particularly a graduated numerical scale over a 180° arc from numbers "8" down to "0". Of course, other scales or calibrations can be used.

With the system of the invention, the ink fountain setting procedure is to first adjust the ink fountain screws 26 so that there is an even flow of ink being fed to the ink rollers and to obtain proper print density of ink. The latter can be determined by using a color chart and a densitometer. Preferably, the color density should be within ±0.04 of the digital densitometer reading throughout the copy area. A sufficient number of copy sheets should be run to insure that the ink and moisture have leveled out and the ink density is constant. The operator now has attained a "base line setting" for the ink fountain.

Once the base line setting is attained, face plate 42 is positioned over knurled heads 30 of the thumb screws and fixed in place by bolts 44. Caps 34 are positioned over heads 30 with their indicator lines 48 in line with the respective numerals "8" on the graduated scales, as shown in FIG. 1, and are locked in those positions by set screws 40. The system now has a base line setting for the ink fountain, and a visual, calibrated, quick reference of this ink flow setting is provided for all types of copy layouts and/or jobs. FIG. 1 shows all of the caps in a common horizontal line representing the base line setting.

The operator now takes his job. copy and clamps it between face plate 42 and clamp plate 47 so that the copy is centered on the ink fountain and hangs downwardly below the caps 34. Springs 52 on the spring-loaded bolts 49 yield to allow clamp plate 47 to "open" away (rearwardly) from face plate 42 for insertion of the copy, and the springs are effective to clamp the copy between the plates.

The operator now can adjust the thumb screws by grasping and rotating caps 34 away from the "8" position, with the "0" position completely cutting off ink flow in that area of the fountain blade corresponding to the respective thumb screw, in order to set the ink fountain to print according to the copy, following normal procedures.

FIG. 3 shows the caps in different adjusted angular positions. The two left-hand caps have been rotated a full 180 degrees so that their indicator lines 48 (FIG. 1) are on "0" of the graduated scales. This may be to cut off ink flow at the left-hand margin of the sheet, for instance. Once set, the operator has a visual, complete calibration of the proper ink fountain setting for that job. Job record sheets can be provided and the positions of all the set screws relative to their graduated dials can be recorded for future, repeat performance of the same job.

Figure 4:
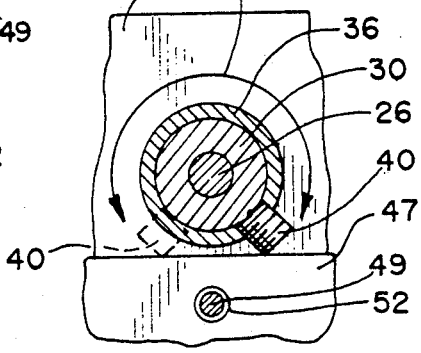
FIG. 4 is a vertical section taken generally along the line 4—4 of FIG. 3.

Lastly, a further feature of the invention is the provision of means for preventing rotation of the thumb screws more than 360 degrees after the caps are positioned thereon. In other words, it would do little good to place caps over the thumb screws if the caps could be rotated a full 360 degrees, i.e., to bring indicator lines 48 back to their same positions which would give a false indication of proper adjustment. This means is provided by clamp plate 48 (FIGS. 2 and 4) also comprising an abutment plate. This abutment plate is in the path of rotational movement of set screws 40 such that a stop means is provided as shown in FIG. 4. Should any cap or thumb screw be rotated away from its proper position of adjustment, as indicated by double-headed circular arrow "A" in FIG. 4, its respective set screw 40 will engage abutment plate 48 as a stop means.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In an ink fountain assembly for use in duplicating machines, such as rotary offset lithographic machines, including a fountain trough having an elongated blade and an ink fountain roller defining a gap therebetween, a plurality of independently adjustable thumb screws for varying the gap and the ink flow therethrough, a plurality of caps positionable over the thumb screws in any angular position relative thereto, the caps having indicating means for indicating positions of adjustment of their respective thumb screws, and mechanical clamping means immediately adjacent said caps for releasably holding a sheet to be copied.

2. In an ink fountain assembly as set forth in claim 1 wherein said mechanical means for releasably holding a sheet to be copied include spring loading means.

3. In an ink fountain assembly as set forth in claim 1 wherein said thumb screws are arranged in a row, and said mechanical means for releasably holding a sheet to be copied comprise an elongated clamp plate extending along the row of thumb screws.

4. In an ink fountain assembly as set forth in claim 3 wherein said clamp plate is located immediately below the thumb screws.

5. In an ink fountain assembly as set forth in claim 3, including means for spring loading said clamp plate for readily clamping and releasing the sheet to be copied.

* * * * *